US010677493B2

(12) United States Patent
Sekhar

(10) Patent No.: US 10,677,493 B2
(45) Date of Patent: Jun. 9, 2020

(54) INDUSTRIAL HEATING APPARATUS AND METHOD EMPLOYING FERMION AND BOSON MUTUAL CASCADE MULTIPLIER FOR BENEFICIAL MATERIAL PROCESSING KINETICS

(71) Applicant: Jainagesh Sekhar, Cincinnati, OH (US)

(72) Inventor: Jainagesh Sekhar, Cincinnati, OH (US)

(73) Assignee: MHI Health Devices, LLC, Cincinnati, OH (US)

( * ) Notice: Subject to any disclaimer, the term of this patent is extended or adjusted under 35 U.S.C. 154(b) by 386 days.

(21) Appl. No.: 15/600,824

(22) Filed: May 22, 2017

(65) Prior Publication Data

US 2017/0347440 A1 Nov. 30, 2017

Related U.S. Application Data

(60) Provisional application No. 62/341,674, filed on May 26, 2016.

(51) Int. Cl.

| | |
|---|---|
| ***F24F 3/00*** | (2006.01) |
| ***F24H 3/02*** | (2006.01) |
| ***F24H 3/04*** | (2006.01) |
| ***H05H 1/20*** | (2006.01) |

(52) U.S. Cl.
CPC ..... *F24H 3/02* (2013.01); *F24H 3/0405* (2013.01); *H05H 1/20* (2013.01)

(58) Field of Classification Search
CPC ... F24H 3/02; F24H 3/022; F24H 3/04; F24H 3/045; F24H 3/06; F24H 3/062; F24H 3/08; F24H 3/081; F24H 3/082; F24H 3/0405; H05H 1/20
USPC ..... 219/121.5, 121.51; 392/379–385
See application file for complete search history.

(56) References Cited

U.S. PATENT DOCUMENTS

| | | | | |
|---|---|---|---|---|
| 2,429,303 | A * | 10/1947 | Apatow | H05B 3/80 219/523 |
| 3,885,126 | A * | 5/1975 | Sugiyama | B60H 1/0025 392/485 |
| 5,058,196 | A * | 10/1991 | Nakamura | F24C 7/043 126/91 R |
| 5,134,684 | A * | 7/1992 | Mishou | F24H 3/0405 392/379 |
| 5,963,709 | A | 10/1999 | Staples | |
| 6,816,671 | B1 | 11/2004 | Reddy et al. | |
| 8,895,888 | B2 | 11/2014 | Burada et al. | |
| 2007/0145038 | A1* | 6/2007 | Vissa | H05B 3/44 219/535 |
| 2008/0071232 | A1* | 3/2008 | Ober | A61N 1/14 604/293 |

(Continued)

*Primary Examiner* — Sang Y Paik
(74) *Attorney, Agent, or Firm* — Michael C. Connelly

(57) ABSTRACT

Presented is a simple, but highly energy efficient industrial heating device and method for rapid heating and high temperature gradient production whereby fermions and bosons are introduced into an adjoining fluid which may be boundary layered and consequently produce an amplifiable activated condition even at room pressure and high temperature. This heating device uses a comparatively long current carrying member which may have some curvature with penetration of the current carrying members into spaces that could have any cross-sectional geometry in a high temperature resistant stable material.

20 Claims, 7 Drawing Sheets

(56) References Cited

U.S. PATENT DOCUMENTS

| | | | | |
|---|---|---|---|---|
| 2010/0012827 | A1* | 1/2010 | Vestergaard Hau ... | B82Y 10/00 250/251 |
| 2013/0264326 | A1* | 10/2013 | Tiras ..... | F27D 11/02 219/385 |

* cited by examiner

INDUSTRIAL HEATING APPARATUS AND METHOD EMPLOYING FERMION AND BOSON MUTUAL CASCADE MULTIPLIER FOR BENEFICIAL MATERIAL PROCESSING KINETICS

CROSS-REFERENCE TO RELATED APPLICATIONS

This application claims the benefit of U.S. provisional application 62/341,674 filed on May 26, 2016 the disclosure of which is incorporated by reference herein in its entirety.

BACKGROUND

For many years, hot air blowers have been used for a wide variety of applications including direct heating of parts and surfaces, incineration of gas particulates and heating enclosed chambers. More particularly, hot air blowers were, and are still, being utilized for refractory curing, plastics sealing, cleaning diesel exhaust and retrofitting gas fired ovens and furnaces.

Blowers used for such applications typically comprised a blower fan, an electric heating element and a housing for the heating element. The blower forced air or gas into the housing through an inlet at one end of the blower. The air was then heated by convection and radiation as it passed near the heating element and was provided at the outlet end of the blower.

For better performance of the above applications, it became desirable to construct hot air blowers that could produce higher gas temperatures than, the then, current blowers could achieve. Higher energy efficiency was desired as well. Furthermore, it became desirable to produce hot gas blowers which could produce and transfer plasma instead of simply un-disassociated hot gas since such a method dramatically improves the heat transfer coefficient. Also, the production of blowers of a design whereby, metallic elements contained therein, do not crack when the element attains a certain temperature relative to the air passing near the element was sought in the industry.

The above issues were addressed by U.S. Pat. No. 5,963,709, entitled "Hot Air Blower Having Two Porous Materials and a Gap Therebetween" by Staples et al. and U.S. Pat. No. 6,816,671, entitled "Mid Temperature Plasma Device" by Reddy et al. both of which are incorporated by reference in their entireties. Very hot gas and plasma were produced by forcing air or gas through multiple layers of a porous material producing a tortuous flow for the gas to travel through. The porous material was in layers, separated by an air gap, through which at least one heating element would pass as well as passing through the porous material. The gap provided a residence time for the gaseous flow to heat further. The tortuous flow combined with the residence time provided by the gap and the resulting convective and radiative heat would thereby produce a plasma.

Currently, even more energy efficient and higher temperature and plasma activity generators are needed in science and industry. A device employing the amplification of fermions and bosons, present in the plasma, which will meet current needs is described in the present application. Thus, by simple means but non-intrusive methods, considerable heat can be ionically transported.

SUMMARY

An industrial apparatus and method are provided such that fermions may be amplified to produce activated species using low energy, in the order of a few kW. Such apparatus and methods contrast with the megawatt powered units currently used for such emissions in large colliders which are unavailable for use in small industry. With fermions, reactions of the kind, $$e-+A2-\rightarrow A^{*}2+e-$$

$$e-+A2-\rightarrow 2A^{*}+e-$$

$$e-+A2-\rightarrow A++A-+e-$$

$$e-+A2-\rightarrow A+2+2e-$$

$$e-+A2-\rightarrow A++A+2e-$$

$$e-+A2-\rightarrow A-+A^{*}$$

may be achieved, especially catalyzed by bosons and fermions, where e− is a symbol for an active electron, A is a chemical species and A* is an activated species. Thus, by producing activated species (e.g. A*) even in complex combinations of metals, silicides, carbides, nitrides, oxides, oxynitrides, diamonds/carbon, borides, polymers, ceramics and composites and intermetallics, very rapid kinetics of reactions can be achieved which can transfer recombination and heat differently than standard conduction, convection or mere pure radiation.

The theoretical basis for interaction has been shown in the BCS superconductivity theory. In the BCS (Bardeen, Cooper and Schaffer) theory of superconductivity, coupled pairs of electrons act like bosons and condense into a state which demonstrates zero electrical resistance. Reference is made to Yukikazu Itikawa et al, J. Phys. Chem. Ref. Data, Vol. 35, No. 1, 2006 who calculated that extremely high cross sections could be achieved at low eV if interactions and amplification were allowed. However, it has not been possible prior to this application to make a small kW device with continuous hole cross sections where activated species with extremely hot gasses could be obtained with catalytic employment of stimulated fermions and bosons. Such an apparatus could enhance industrial processes, such as nitriding or oxynitriding, where extremely rapid kinetics could be achieved by transferring heat and activated stimulation to a location which is further away from where they are created. When fermions are involved, it is well known in the chemistry literature that the kinetics of reaction can be greatly enhanced by the use of ions. Such will also lead to more efficient use of energy in fuel cells.

Although some plasma temperatures from conventional generators may be manipulated to have lower temperatures, there are other problems for economical use when such modifications are attempted. For example transferred arc induc ion plasmas are noisy and extremely costly for use in the 700 C range of temperatures where aluminum is melted and cast. Additionally, the conversion efficiency and power transfer efficiency of the transferred arc plasma is very low (single digits for these low temperatures) thus negating economical use. A new mid temperature range (700 C 1300 C) convective plasma device is described herein. This new system is extremely quiet and seemingly offers the possibility of close to 100% power transfer efficiency. The use of this source with the novel heat transfer mechanism is expected to give rise to a host of new energy efficient technologies.

DRAWINGS—FIGURES

DRAWINGS—REFERENCE NUMERALS

Figure 1:
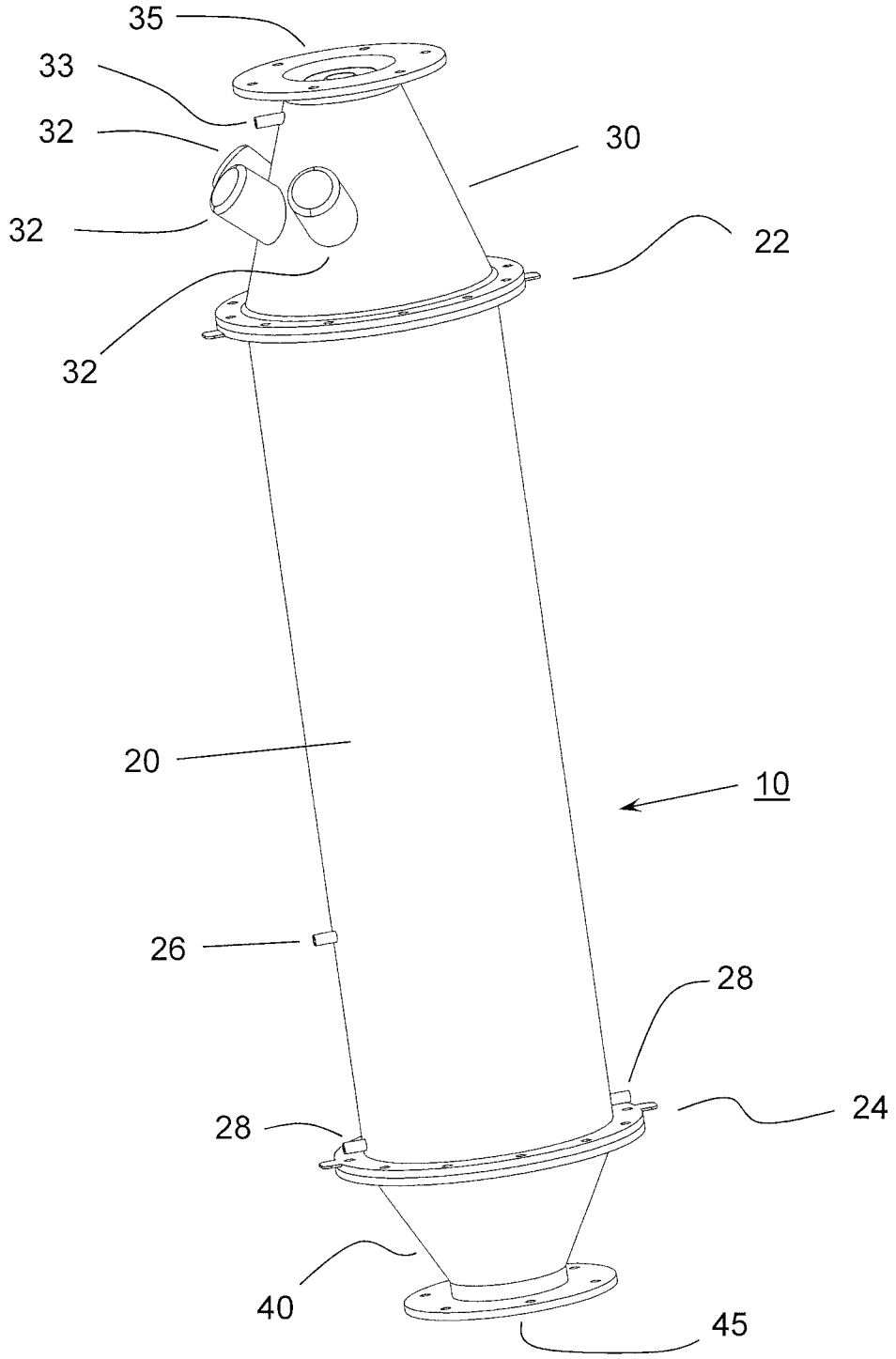
FIG. 1 is an overall view of an embodiment of an industrial heating device for rapid heating and high temperature gradient that introduces fermions and bosons into an adjoining fluid

| | | | |
|---|---|---|---|
| 10. | industrial heating device | 20. | outer casing |
| 21. | casing flange | 22. | intake end |
| 24. | exhaust end | 26. | mid-casing thermocouple port |
| 28. | exhaust thermocouple port | 30. | intake cap |
| 31. | intake cap flange | 32. | power access port |
| 33. | intake thermocouple port | 35. | intake port |
| 40. | exhaust cap | 41. | exhaust cap flange |
| 45. | exhaust port | 50. | current carrying member |
| 52. | straight member segment | 54. | u-shaped member segment |
| 55. | member terminal end | 60. | refractory core |
| 61. | insulative wrap | 65. | member channels |

DETAILED DESCRIPTION

It has been found that a simple but highly energy efficient device is possible for the rapid heating and a high temperature gradient which introduces fermions and bosons into an adjoining fluid and one which could be boundary layered and consequently produce an amplifiable activated condition even at room pressure and high temperature. This is a wholly unanticipated and unexpected finding, and, although the comprehensive theoretical basis is not completely understood, it has been found that an unusual rapid heating can be created, as well as, transferred surface activation by using a comparatively long order of 10-100 cm current carrying member with none, or some curvature (radius of curvature exceeding 0.5 meter), and >100 amps current with penetration of the current carrying members into spaces that could have any cross sectional geometry (e.g. circular holes, ellipsoids or square cross section) in a high temperature resistant stable material. The holes are expected to have a diameter in the range of millimeters to tens of millimeters.

In one embodiment, the apparatus consists of long current carrying members connected by a plurality of holes. In such an apparatus, extremely hot temperatures are achieved. The holes may be from 0.1 mm to 100 mm in diameter. Currents passing through the current carrying members may range from 80 to 350 amps. Voltages, unlike those used in plasma devices, can be small with frequencies remaining in the Hz range when AC current is used. Unique reactions of the type $19Fe+4N(g)+O(g)+3H_2O(g)=Fe_3O_4+4Fe_4N+3H_2(g)$ can easily be catalyzed or enabled by key fermions and bosons and actuated species. Cavitation and pressure differentials promote fermions and are additionally stimulated by bosons.

In another embodiment, the channels or holes through which the current carrying members are between 6-12 mm in diameter. These channels may be surrounded by a series of smaller channels or holes at around 1 mm in diameter. The smaller channels may differ in size and in cross-sectional shape from each other. The smaller holes may be arranged symmetrically or asymmetrically around the current carrying member channels and may follow the path of the member channels in a parallel, or near parallel, manner. Such smaller channels assist in the production of greater output temperatures for the device.

Another embodiment of the device has current carrying members or elements bent in elongated u-shapes. A continuous element bent in such a u-shaped configuration may pass through channels or holes in a refractory or other material. Separate u-shaped current carrying members are anticipated as well, which may each, individually, be connected to a power source. The long straight segments of the elements run through these channels while the curved or u-shaped segments are outside of the refractory. A current is passed through the element thus producing heat. A gas is projected through the refractory, which is porous, along the direction of the long straight segments of the element. The gas is heated in this manner producing a plasma which is projected out of the device. The device may be encased in a shell consisting of appropriate material. As stated above, smaller parallel channels may be symmetrically positioned around the element channel Both symmetric, non-symmetric and combinations are anticipated. Coils, u-shapes, sheet and other geometries of current carrying members are fully anticipated. Elements with a radius of curvature in the range of approximately 1 to 25 millimeters are contemplated.

In the best mode known to date we find that using tungsten containing molybdenum disilicide heating elements of diameter 2-6 mm in a U or coil configuration yielded a plasma at a temperature of about 1110° C. For coating applications experiments indicated that plasma assisted coatings could be applied on metals, alloys and ceramic substrates with a very little investment unlike the physical or chemical vapor deposition. 3 to 4 KW power devices using air as gaseous medium has produced reddish colored plasma typical of air. Good adherent coatings including bronze on aluminum, tungsten carbide on alumina and aluminum on alumina were produced on a substrate. Powdered precursor made to flow in to plasma when exit temperatures were in the range of 1140 to 1300° C.

Figure 2:
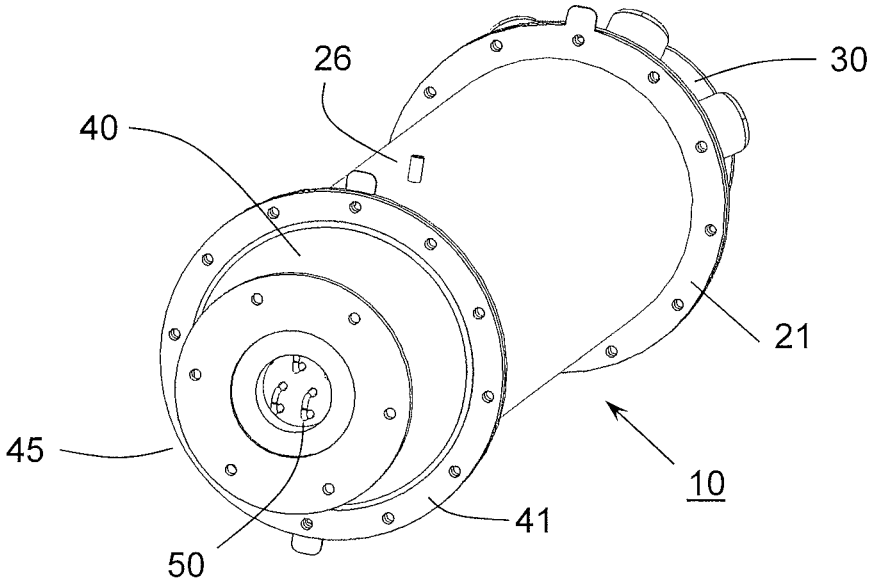
FIG. 2 is a view of the exhaust end of an embodiment of the heating device.
Figure 3:
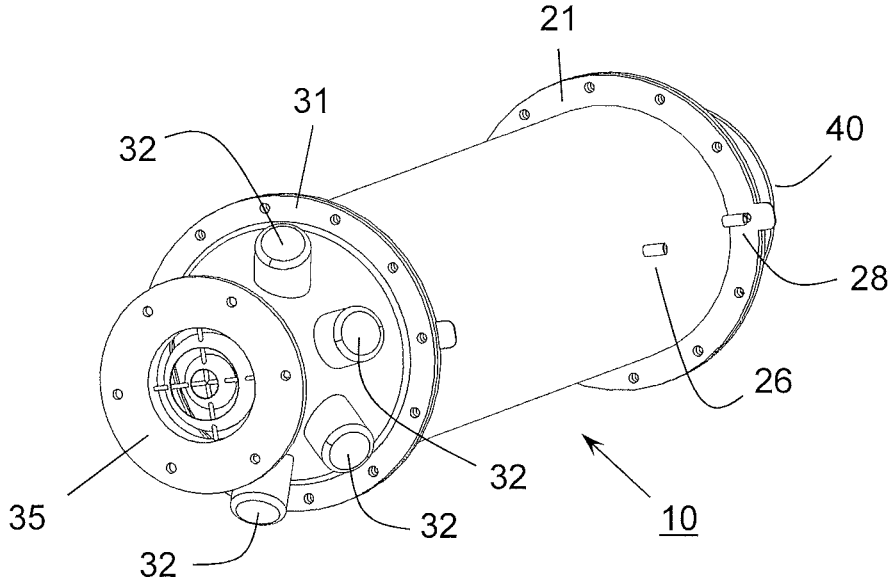
FIG. 3 is a view of the intake end of an embodiment of the heating device.
Figure 4:
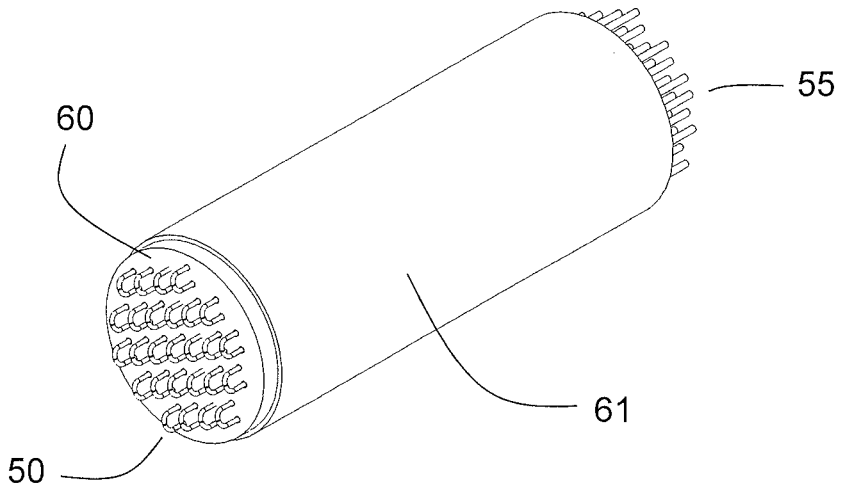
FIG. 4 is a view of the electrically powered heating elements of an embodiment of the industrial heating device positioned within channels through a porous ceramic contained within the outer casing of the device.
Figure 5:
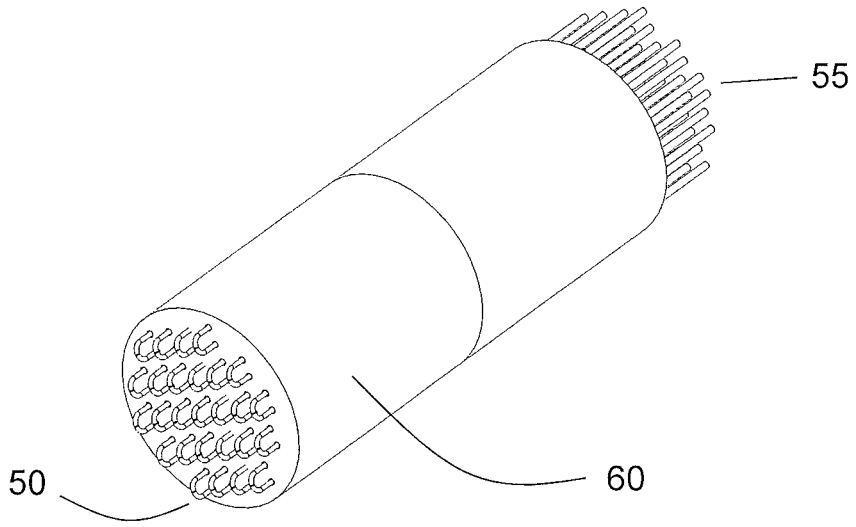
FIG. 5 is a further view of the electrically powered heating elements of an embodiment of the industrial heating device positioned within channels through a porous ceramic contained within the outer casing of the device.
Figure 6:
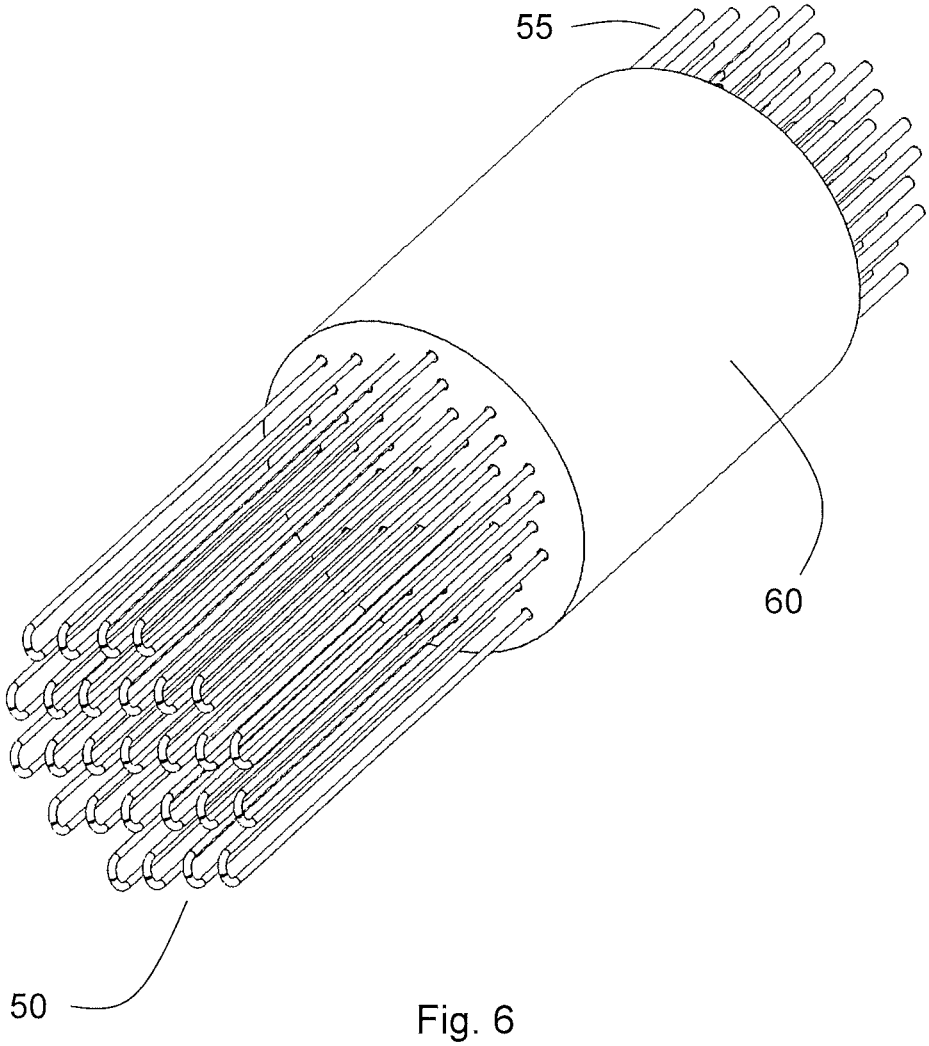
FIG. 6 is a cut-away view of the porous ceramic of the heating device revealing the heating elements passing through the channels of the ceramic.
Figure 7:
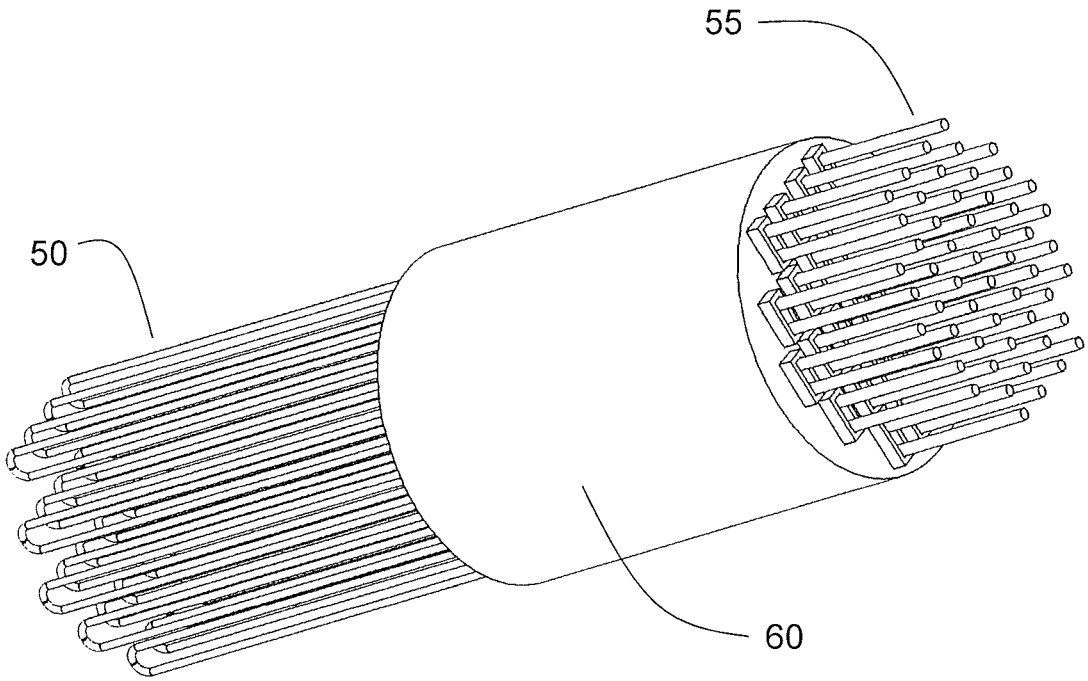
FIG. 7 is a further cut-away view of the porous ceramic of the heating device revealing the heating elements from the terminal ends of the heating elements.
Figure 8:
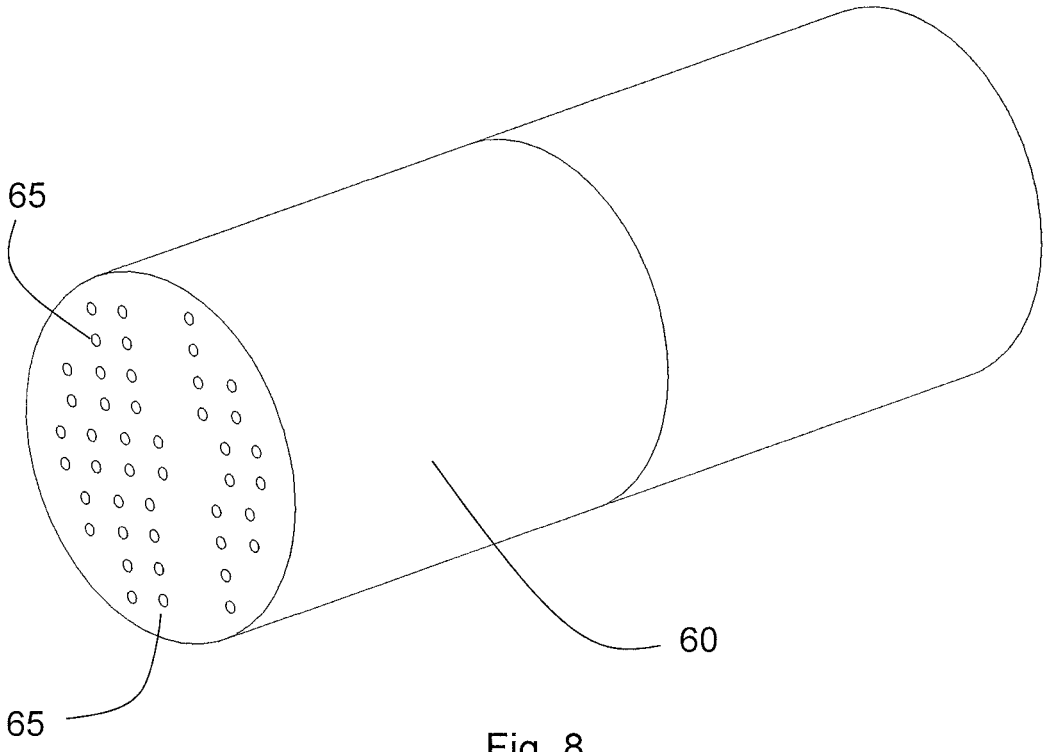
FIG. 8 is an end view of the porous ceramic showing the exit holes of the channels in which the heating elements are positioned.
Figure 9:
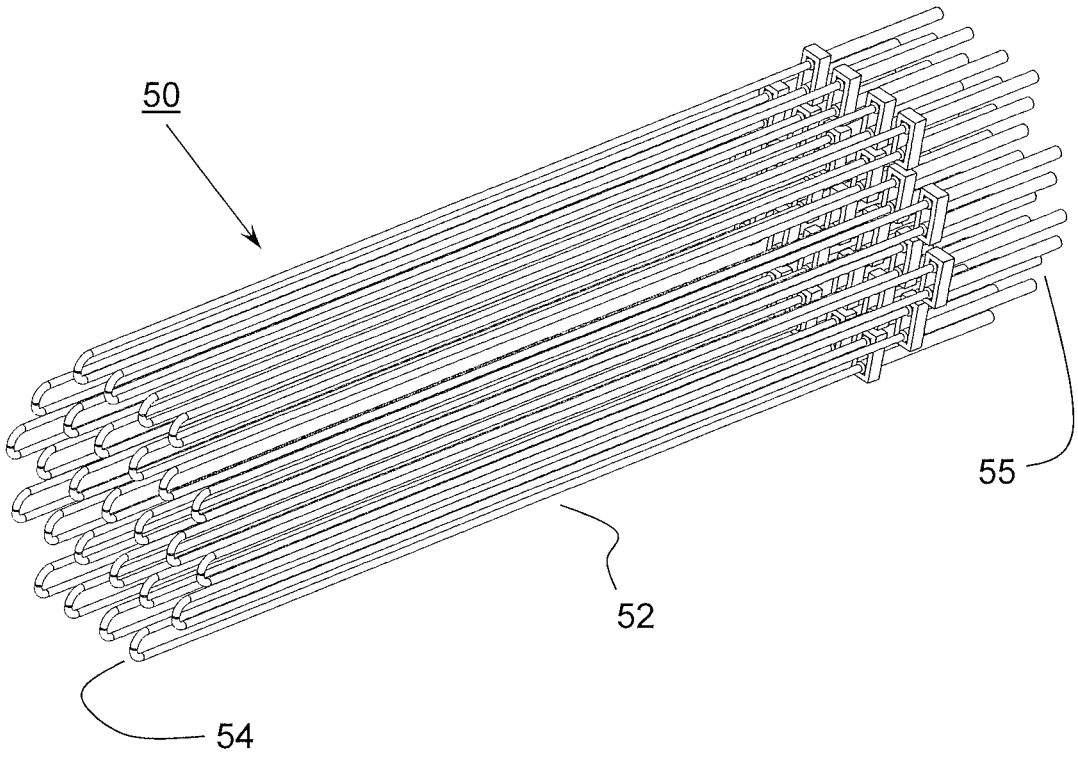
FIG. 9 is a view of the heating elements of the industrial heating device.

A preferred embodiment of the device for rapid heating of a gaseous multi-species fermion and boson containing flow is depicted in FIGS. 1-9. The industrial heating device 10 comprises an outer casing 20, constructed of suitable high temperature resistant materials, having an intake end 22 and an exhaust end 24. The intake end 22 is fitted with an intake cap 30 which has an intake port 35 positioned and designed to allow the introduction of a gaseous flow into the casing 20. A means to project the gaseous flow would be located at the intake cap 30 and in communication with the intake port 35. The intake cap 30 may have one or more power access ports 32 which allow access into the intake cap 30 for electrical, control and any other necessary connections. The intake cap 30 is equipped with an intake thermocouple port 33 to measure the temperature of incoming gas. A mid-casing thermocouple port 26 and at least one exhaust thermocouple port 28 are positioned on the casing 20 allowing for temperature readings within the heating device 10. The casing 20 is also fitted with an exhaust cap 40 with an exhaust port 45 attached at the exhaust end 24 of the casing 20. In this embodiment, the casing 20 is round in cross section with an elongated straight configuration resulting in a cylindrical appearance, but other geometries are contemplated. The casing 20 may have a casing flange 21 on each end that mate up with a corresponding intake cap flange 31 and exhaust cap flange 41. Suitable gasket material may be positioned between the flanges which are attached with bolts (not pictured).

A high temperature resistant ceramic, refractory or other suitable material is positioned inside of the casing 20. The intake cap 30 and the exhaust cap 40 may also be lined with a ceramic material. In this embodiment, the ceramic material is comprised of a refractory core 60 inside of an insulative wrap 61. The refractory core 60 extends, in an uninterrupted manner, the length of the casing 20 and has at least one channel 65 cut or formed through the length of the core 60 parallel to the elongated straight dimension of the casing 20. The channels 65 are sized to accept current carrying members 55. The diameters of the channels 65 and the members 55 are designed to allow the gaseous flow to be directed through the channels 65 axially along the length of, and in contact with, the members 55. Further channels may be included through the length of the core 60 to allow extra flow of the gas. The core 60 material may be porous to permit even more gaseous flow to the exhaust end 24 of the casing 20. The core 60 may be in one piece or in multiple sections abutted together and may be covered with a insulative wrap 61.

In the present embodiment of the heating device 10 the current carrying members 50 are each configured to have two long straight member segments 52 connected by one u-shaped member segment 54. Axial flow along the length of the elements is noted to be better than cross-flow (flow across the elements). The long straight segments 52 may also be connected with a twist rather than a u-shaped segment 54. Each straight segment 52 has a terminal end 55 attached by which a power source is electrically connected to the elements 50. At least one element 50 will be fitted within the core 60. The long straight segments 52 are each individually inserted into an uninterrupted channel 65 in the core 60. The straight segments 52 are encased in the core 60 along their entire lengths with no gaps in the core 60 and in this manner are the channels 65 and core 60 are uninterrupted along their lengths. However, the u-shaped segment 54 attaching the two straight segments 52 for each current carrying member 50 is positioned out side of the core 60 and the channels 65 (FIGS. 4-7) at the exhaust end 24 of the casing 20. The terminal ends 55 of the members 50 project out at the intake end 22 of the core 60. The straight segments 52 are held snugly within the channels 65, but there is enough clearance for the gaseous flow to travel through the channels 65 while making direct contact with the members 50. Heat is thus transferred from the current carrying members 50 to the flow. Parallel channels and porosity in the core material also allow gaseous flow and heat transfer from the members 50 and the core 60 to the gaseous flow.

Operation

In operation, a gaseous multi-species fermion and boson containing flow is forced by a means of projection into the intake end 22 of the heating device 10. As stated, the means of forcing the gaseous flow into the heating device 10 may be a fan, compression or other instrumentalities. The gaseous flow is pushed through a block or core 60 of high temperature resistant material having channels 65 or grooves cut into the core 60. The channels 65 contain current carrying members 50 which are connected to a power source allowing the members 65 to be electrically charged to produce a desired heat. The gaseous flow is driven through the channels 65 by, and in contact with, the heated members 50 thereby picking up heat from the channels and the core 60 material. The flow is to be along the long axis of the current carrying members 50 and not across this axis. The core 60 may also have parallel channels not containing heating elements and may be porous thus allowing more pathways for the gaseous flow to travel through the core 60. The porosity of the core 60 material may be interconnected and provides a tortuous path for the gas to follow allowing for greater heat transfer from the elements to the core 60 material and ultimately to the gaseous flow. Contact with the heated members 50 and the heated core 60 material and the extended dwell time in the cores 60 channels and porosity allow for an efficient and large transfer of heat to the gaseous flow. The flow is constricted in the channels and porosity and is in constant contact with heated members and/or core 60 material from the intake end to the exhaust end of the core 60. The gas flow may show electrical conductivity because of the fermions such as electrons. However, the electrical resistance will be measured in mega-ohms.

The above descriptions provide examples of specifics of possible embodiments of the application and should not be used to limit the scope of all possible embodiments. Thus, the scope of the embodiments should not be limited by the examples and descriptions given, but should be determined from the claims and their legal equivalents. For example, finned or dimpled elements with or without twists are contemplated. Far ranging fermion and boson interactive effects which are known as quantum separated are fully contemplated, although the physics of quantum separation is not fully understood.

What is claimed is:

1. An industrial device for the rapid and efficient heating of a gaseous multi-species fermion and boson containing flow to over 700° C. comprising at least one heating element, wherein the at least one heating element is comprised of at least one electrically joined current carrying member wherein the current carrying member is comprised of a straight configuration, having a length dimension, a solid cross-sectional dimension and an outer surface area; a temperature resistant material comprising at least one member channel passing therethrough wherein the at least one channel has an uninterrupted length closely corresponding to the length dimension of the at least one member and an inner surface area, wherein the at least one member is contained within the at least one channel and wherein the channel follows parallel to the length dimension of the at least one member; an outer casing having an intake end and an exhaust end in which the temperature resistant material and the at least one current carrying member are contained; and a means to force the gaseous multi-species fermion and boson containing flow through the temperature resistant material and the at least one channel and around and in contact with and between the outer surface area of the at least one member and the inner surface area of the at least one channel and along the length of the at least one member in a predominantly axial manner.

2. The device of claim 1 wherein the means to force the gaseous flow through the temperature resistant material is located at the intake end of the outer casing.

3. The device of claim 1, further comprising a curved current carrying member wherein the length of the at least one curved current carrying member has a radius curvature of approximately one to twenty-five millimeters.

4. The device of claim 1 wherein the temperature resistant material is porous.

5. The device of claim 1 wherein the temperature resistant material is comprised of a ceramic refractory.

6. The device of claim 1 wherein the at least one current carrying member has at least one terminal end projecting out of the temperature resistant material.

7. The device of claim 6 wherein the at least one heating element is further comprised of a second current carrying member comprised of a straight configuration wherein the at least one current carrying member and the second current carrying member are connected by a u-shaped segment and the second current carrying member is contained within a second member channel and wherein the at least one terminal end and the u-shaped segment extend outside of the temperature resistant material.

8. The device of claim 6 wherein the at least one current carrying member and the second current carrying member are connected by a twist and the at least one current carrying member and the second current carrying member are contained within the at least one member channel and the second member channel and wherein the at least one terminal end and the twist extend outside of the temperature resistant material.

9. The device of claim 6 wherein the at least one current carrying member and the second current carrying member are completely contained within the at least one member channel and the second member channel.

10. The device of claim 1 wherein the at least one current carrying member has a geometrical configuration a sheet.

11. The device of claim 1 wherein the temperature resistant material further comprises parallel channels of a smaller diameter than the at least one channel positioned next to and in the same orientation as the at least one member channel.

12. The device of claim 11 wherein the smaller parallel channels are positioned symmetrically around the at least one member channel.

13. The device of claim 11 wherein the smaller parallel channels are positioned asymmetrically around the at least one member channel.

14. The device of claim 1 wherein the means to force the gaseous flow through the temperature resistant material is a fan.

15. The device of claim 1 wherein the means to force the gaseous flow through the temperature resistant material is a pressurization means.

16. A method for the rapid and energy efficient heating of a gaseous flow that introduces fermions and bosons into an adjoining fluid which could be boundary layered and consequently produce an amplifiable activated condition even at room pressure and temperature comprising passing the flow through a temperature resistant material having at least one member channel, having an inner surface area, therein and electrically heating the flow with at least one heating element comprised of at least one current carrying member electrically joined current carrying member comprised of a straight configuration, having an outer surface area, a length dimension and a solid cross-section having an unvarying dimension along the length dimension of the member contained within the at least one member channel wherein the channel follows parallel to the length dimension of the at least one member and wherein the flow passes around and axially along the length of the at least one current carrying member contained within the at least one member channel and between the outer surface area of the at least one member and the inner surface area of the at least one member channel thereby being heated to over 700° C. by the at least one current carrying member and the temperature resistant material.

17. The method of claim 16 wherein the passing of the gaseous flow through the temperature resistant material comprises propelling the flow by the pressurization and compression of the flow.

18. The method of claim 16 wherein the passing of the gaseous flow through the temperature resistant material comprises propelling the flow by the employment of a fan.

19. The method of claim 16 wherein the gaseous flow comprises air.

20. A method for the rapid and energy efficient heating and application of a gaseous flow that introduces fermions and bosons into the flow which could be boundary layered and consequently produce an axially enabled amplifiable activated condition even at room pressure and temperature comprising passing the flow through a temperature resistant material having at least one member channel, having an inner surface area, therein and electrically heating the flow with at least one heating element comprised of at least one electrically joined current carrying member comprised of a straight configuration, having an outer surface area, a length dimension and a solid cross-section having an unvarying dimension along the length dimension of the member contained within the at least one member channel wherein the channel follows parallel to the length dimension of the at least one member and wherein the flow passes around and along the length of the at least one current carrying member contained within the at least one member channel and between the outer surface area of the at least one member and the inner surface area of the at least one member channel thereby being heated to over 700° C. by the at least one current carrying member and the temperature material and projecting the gaseous flow onto surfaces and objects.

* * * * *